US005145527A

United States Patent [19]

Clifford et al.

[11] Patent Number: 5,145,527

[45] Date of Patent: * Sep. 8, 1992

[54] APPARATUS FOR APPLYING FOAMED TREATING LIQUOR

[75] Inventors: Graham F. Clifford, Stanley; James K. Turner, Lincolnton, both of N.C.; Mack W. Spurrier, Clover, S.C.

[73] Assignee: Owens-Corning Fiberglas Corporation, Toledo, Ohio

[ * ] Notice: The portion of the term of this patent subsequent to Aug. 28, 2007 has been disclaimed.

[21] Appl. No.: 366,869

[22] Filed: Apr. 9, 1982

[51] Int. Cl.[5] ..... B05C 5/02

[52] U.S. Cl. ..... 118/411; 118/415; 68/200

[58] Field of Search ..... 118/411, 410, 412, 415; 68/200, 205 R; 425/4 C; 156/78

[56] References Cited

U.S. PATENT DOCUMENTS

| | | | |
|---|---|---|---|
| 2,558,084 | 6/1951 | Gwinn | 118/411 |
| 2,665,189 | 1/1954 | Cox | 8/156 |
| 2,727,488 | 12/1955 | Nerim | 118/410 |
| 3,190,793 | 6/1965 | Starke | 68/200 |
| 3,418,970 | 12/1968 | Phelps et al. | 118/413 X |
| 3,697,314 | 10/1972 | Stritzko | 118/411 X |
| 3,886,769 | 6/1975 | Conti | 68/205 R X |
| 4,061,001 | 12/1977 | von der Eltz et al. | 118/415 X |
| 4,158,076 | 6/1979 | Wallstén | 118/410 X |
| 4,176,619 | 12/1979 | Wappling | 118/410 |
| 4,231,129 | 11/1980 | Winch | 118/65 X |
| 5,008,131 | 4/1991 | Bakhshi | 427/243 X |
| 5,009,932 | 4/1991 | Klett et al. | 427/209 X |

*Primary Examiner*—Evan Lawrence

*Attorney, Agent, or Firm*—Dalbert U. Shefte; Ted C. Gillespie

[57] ABSTRACT

Apparatus particularly adapted for applying foamed treating liquor to a flat width of a traveling non-woven textile substrate includes a longitudinal tubular foam distribution nozzle one side of which has a plurality of closely-spaced staggered apertures for engaging and applying pressurized foam widthwise across the substrate and a driven drum opposed to the nozzle engaging widthwise the opposite side of the substrate for imparting traveling movement to the substrate. The drum and nozzle cooperate to compress the substrate therebetween in covering relation over the apertures to prevent lateral escape of the foam therefrom and to confine the emission of foam therethrough, thereby to uniformly control foam application across the substrate width as it travels by the nozzle. Limited contact of the apparatus with the substrate prevents frictional pulling and structural damage thereto. The drum is perforated for escape of the air component of the foam and to enhance foam penetration of the substrate. If desired, one apparatus may be employed to achieve full substrate penetration or two serial apparatus may be arranged to treat respectively opposite substrate sides for full penetration.

21 Claims, 4 Drawing Sheets

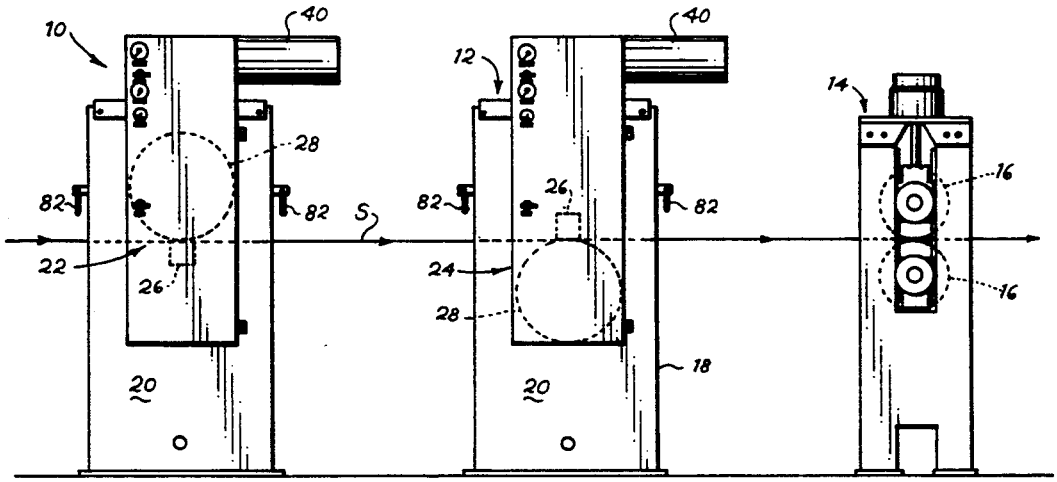
Fig. 1
Fig. 2
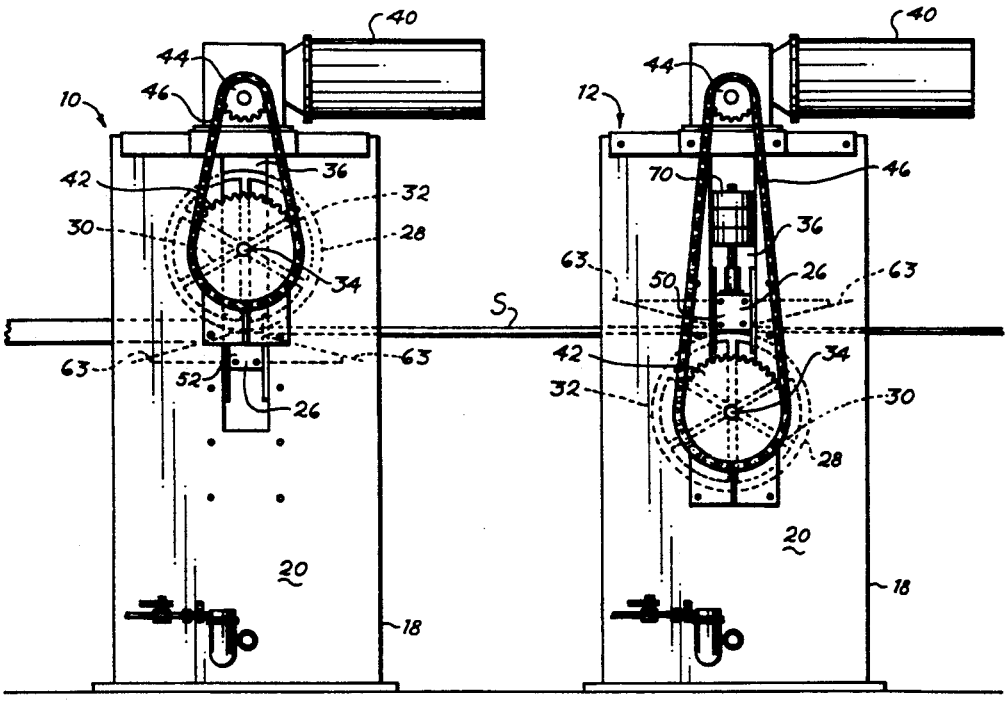

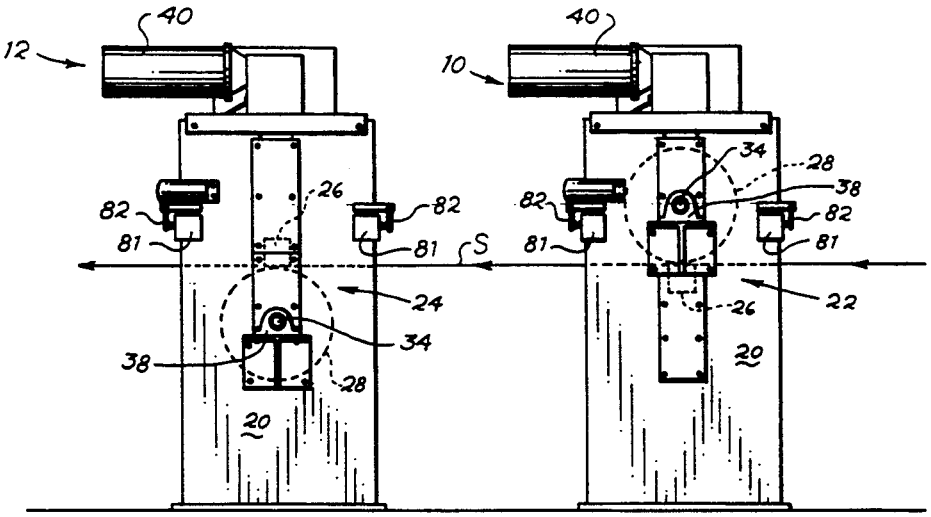
Fig. 3
Fig. 4
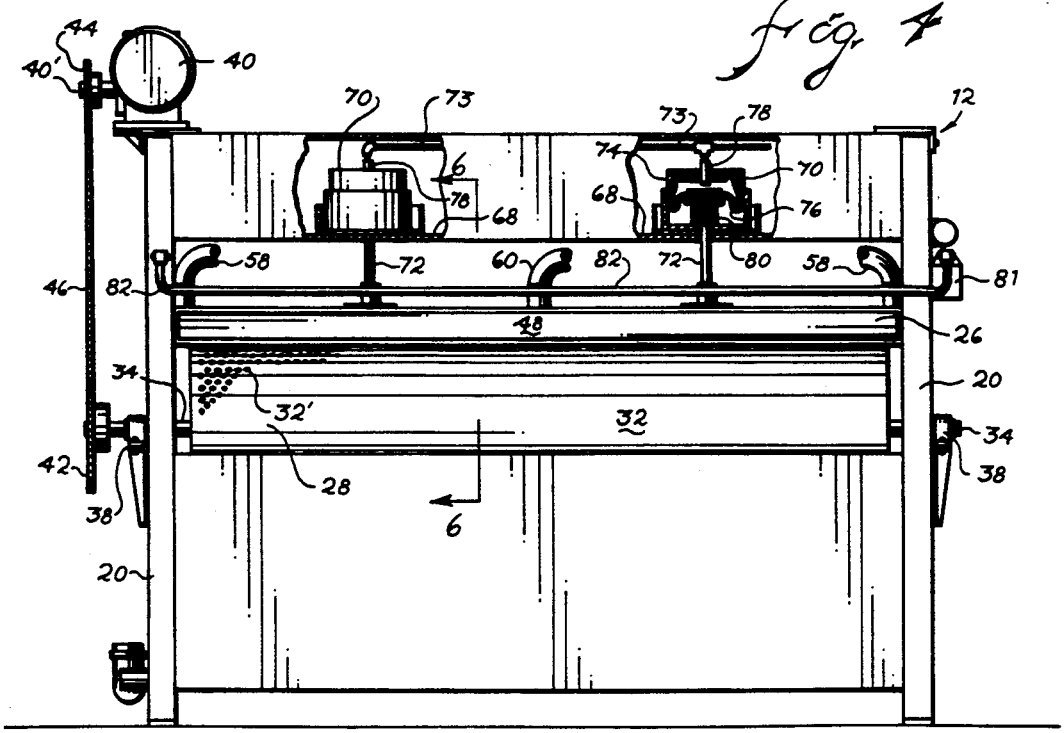

APPARATUS FOR APPLYING FOAMED TREATING LIQUOR

BACKGROUND OF THE INVENTION

The present invention relates generally to apparatus for applying foamed treating material and more particularly to such apparatus for applying foamed treating liquor to a flat width of traveling textile substrate of the non-woven, non-knitted type.

Various apparatus are known for applying foamed treating liquor to a flat width of a traveling textile material of knitted or woven type, examples of such apparatus being disclosed in Clifford and Zeiffer U.S. Pat. No. 4,237,818, and Clifford and Turner U.S. patent application Ser. No. 299,533, filed Sep. 4, 1981, both commonly assigned herewith. Typically, such apparatus employs some form of foam applicator across which the textile material is pulled by driven rollers, which is inappropriate for use in applying treating liquor to textile materials of the non-woven, non-knitted type (hereinafter referred to generically by the common industry term "non-woven" to designate any sheet-like or web material bonded together substantially only by cohesive forces) which materials lack the structural integrity to resist structural damage thereto by the pulling action exerted thereon by the driven rollers of such apparatus.

Accordingly, special apparatus is necessary for the liquor treatment of non-woven materials. Presently, the apparatus available for this purpose employs moving screens or belts of open-work or other permeable construction on which a non-woven web is transported to and from a liquor applicator which is arranged to spray the desired liquor on the web. Several operational and environmental disadvantages are inherent in the use of this type of apparatus. As will be understood, the liquor employed in many cases is a binder or a resin which will necessarily be oversprayed on and adhere to the belt or screen impairing its flexibility and permeability and, in some cases, causing difficulty in the proper tracking of the belt or screen. Further, the spraying technique, even under conditions of overspraying of the treating liquor, generally is ineffective to achieve a desired degree of penetration of the treating liquor into the web and, for this reason, it is customary to perform the spraying operation twice respectively to each side of the web or to apply a vaccuum force through the belt to draw the sprayed liquor into the web. As will be understood, the spraying technique inherently creates a contaminated atmosphere in the vicinity of the applicator and thereby poses a health hazard. Further, the oversprayed liquor which accumulates on the belts and screens and otherwise in the vicinity of the applicator must periodically be washed from the surfaces affected, creating waste water treatment problems. As will be understood, all of these problems contribute to substantially increase the capital investment and operational costs in performing such non-woven treating operations.

In contrast, the present invention provides an apparatus for applying foamed treating liquor to a non-woven textile substrate by which the substrate is contactingly engaged by and compressed against an applicator nozzle for uniform application to and penetration into the substrate of the liquor without significant emission of liquor into the surrounding atmosphere or the adherence thereof onto any operational element of the apparatus and, further, without structurally damaging the substrate.

SUMMARY OF THE INVENTION

Briefly described, the present apparatus for applying foamed treating liquor to a flat width of traveling substrate includes an applicator nozzle having a flat longitudinal substrate engaging surface disposed to extend transversely across the substrate width in direct surface contact compressively with one side thereof and a rotatably driven cylindrical drum axially disposed substantially parallel and in opposition to the nozzle engaging surface transversely across the width of the opposite side of the substrate in peripheral surface contact compressively therewith for drivingly engaging the substrate to impart movement thereto in its direction of travel. The nozzle has formed internally thereof a foam distribution chamber communicating with a pressurized foamed liquor generator and includes a plurality of closely-spaced apertures extending between the chamber and the engaging surface along the length thereof for emitting foamed liquor for application to the one side of the substrate. The drum and the nozzle cooperate to compress the substrate against the nozzle engaging surface in covering relation to the apertures sufficiently to prevent escape of the foamed liquor laterally across the substrate engaging surface between it and the substrate and to confine the emission of foamed liquor through the apertures to the substrate for controlled application of said foamed treating liquor to the one side of the substrate and, in this manner, the foamed liquor is applied uniformly to the one side of the substrate across its width and length as it travels past the nozzle.

In the preferred embodiment, the nozzle includes a tubular member forming therewithin the distribution chamber and having at least one flat side forming the substrate engaging surface in which the apertures are formed. The apertures are arranged along the nozzle in two staggered linear rows the respective apertures of which staggeringly overlap in the direction of substrate travel to collectively apply the foamed liquor across the entire widthwise extent of the substrate. Further, the apertures are outwardly flared to the engaging surface to increase the area of application to the substrate of each aperture. The substrate engaging surface is of a relative small extent in the direction of substrate travel for limiting contact therewith to reduce frictional resistance to the traveling movement of the substrate.

The drum is indentedly relief-formed about its peripheral surface for the escape of the air content of the foamed liquor through the substrate into the indentations thereby to enhance the penetration of the substrate by the liquor. Preferably, the drum is hollow with a perforated periphery having plural axially-extending linear rows of closely-spaced, staggered, outwardly-flared apertures about the entire peripheral surface of the drum. The arrangement for rotatably driving the drum provides for the control of the rotational speed thereof for controlling the quantity of the foamed liquor applied to the substrate per unit area thereof.

The preferred embodiment also includes a pair of pneumatically actuated and connected piston and cylinder assemblies on which the nozzle is mounted for movement toward and away from the drum thereby for biasing the nozzle toward the drum to provide the compressive force exerted therebetween on the substrate.

If desired, a second liquor-applying apparatus of like construction may be provided sequentially following the above-described first apparatus, the first apparatus having the substrate engaging surface of its nozzle arranged to engage the one side of the substrate with the drum of such first apparatus engaging the opposite side of the substrate and the second apparatus having the substrate engaging surface of its nozzle arranged to engage such opposite side of the substrate with the drum of such second apparatus engaging the one side of the substrate, whereby the two apparatus respectively apply said foamed liquor to the opposite sides of the substrate for complete penetration thereof.

BRIEF DESCRIPTION OF THE DRAWINGS

FIG. 1 is a schematic right side elevational view of a station for the treatment of a flat width of traveling substrate with foamed treating liquor, including apparatus according to the preferred embodiment of the present invention for applying the treating liquor to the substrate;

FIG. 2 is a right side elevational view of the liquor-applying apparatus of FIG. 1 with the control panels removed;

FIG. 3 is a left side elevational view of the liquor-applying apparatus of FIG. 2;

FIG. 4 is a rear elevational view of the second liquor-applying apparatus of FIG. 2;

DESCRIPTION OF THE PREFERRED EMBODIMENT

Figure 5:
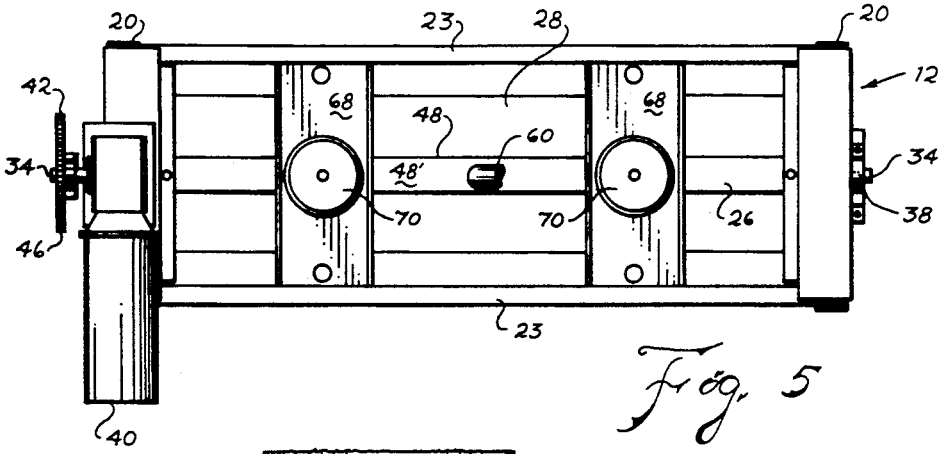
FIG. 5 is a plan view of the second liquor-applying apparatus of FIG. 2.

Referring now to the accompanying drawings, the apparatus of the present invention is herein illustrated and described in its preferred embodiment for applying a foamed aqueous-based binder to the opposite sides of a traveling web of non-woven batting; for example, fiberglass batting such as is employed for insulating purposes. However, it will be understood that the present invention is equally applicable for use with a wide variety of other materials as well. In the accompanying drawings, the apparatus for applying foamed treating liquor according to the present invention is illustrated in two forms incorporated respectively in two treating machines, indicated generally at 10 and 12, serially-arranged as successive stations in a substrate treating range through which the substrate travels in a horizontal, linear path widthwise parallel to horizontal as a flat width of traveling substrate S. An appropriate transport device 14 is arranged following the liquor applying machines 10,12 and includes oppositely driven nip rollers 16 to engage the treated substrate S and convey it to the following station in the treating range. Such transport devices 14 are known and form no part of the present invention and, accordingly, will not be described herein.

The machines 10,12 are of substantially similar construction and operation, including identical components, and, accordingly, the description thereof hereinis considered applicable to each machine 10,12 except as the particular differences of the machines 10,12 are specifically indicated hereinafter. Like reference numerals are employed for the corresponding components of each machine 10,12.

Each machine 10,12 has a supporting frame 18 on which the liquor-applying apparatus of the present invention and the other operative components of the machine are operatively mounted. The frame 18 includes an opposed pair of upstanding end frame members 20 rigidly joined at their lower ends by an appropriate cross member base framework generally indicated at 21 and at their upper ends by cross-members 23 at a sufficient spacing to permit the substrate S to pass between the end frame members 20. A control panel 19 in which may be housed appropriate machine control mechanisms, gauges and the like is mounted on one end frame member 20 of each machine 10,12. The liquor applying apparatus of the machines 10,12 are indicated respectively at 22,24. Each apparatus 22,24 includes a foamed liquor applicator nozzle 26 and a driven cylindrical drum 28 respectively mounted to extend horizontally between the end frame members 20 of the machine in opposed facing disposition transversely across the path of travel of the substrate S on opposide sides thereof for passage of the substrate S therebetween for application of the foamed treating liquor thereto by the nozzle 26. In the liquor applying apparatus 22 of the machine 10, the nozzle 26 is disposed above the path of the substrate S with the drum 28 disposed therebelow for application of the treating liquor to the upwardly facing surface of the substrate S while, in the liquor applying apparatus 24 of the machine 12, the nozzle 26 is disposed below the path of the substrate S with the drum 28 disposed thereabove for application of the treating liquor to the underside of the substrate S.

Each drum 28 of the liquor applying apparatus 22,24 of the machines 10,12 includes a pair of spoked, circular end hubs 30 spaced apart in co-axial relation and between which are intermediately disposed spacedly in coaxial relation therewith several circular supporting rings (not shown) of equal diameter, a perforated or otherwise indentedly relief-formed sheet of stainless steel 32 being bent circumferentially about the rings and hubs 30 and fixedly joined thereto to form the cylindrical outer surface of the drum 28. An axial shaft 34 extends centrally through each drum 28, through the axial center of its end hubs 30 to which the shaft 34 is fixedly joined, and axially outwardly of the drum 28 therefrom. The end frame members 20 of each machine 10,12 are provided with corresponding, aligned vertical slots 36, the drum 28 of each machine 10,12 extending horizontally between the end frame members 22 thereof with the outwardly extending end portions of the shaft 34 extending respectively through the slots 36 and mounted respectively in appropriate bearing assemblies 38 affixed to the outward sides of the end frame member 20 at a location spaced from the path of the substrate S an appropriate distance to dispose the drum 28 for rotation substantially peripherally tangential to the path of the substrate S. As will be understood, the drum 28 of the machine 10 is so mounted upwardly in the slots 36 of the end frame members 20 thereof for peripherally tangential engagement of the upward side of the substrate S, while the drum 28 of the machine 12 is so mounted downwardly in the slots 36 of the end frame members 20 thereof for peripherally tangential engagement of the underside of the substrate S.

A variable speed electric motor 40 of any conventional construction appropriate for rotatably driving a drum 28 is mounted on each machine 10,12 at the upper end of one of its end frame members 20 with the drive shaft 40' of the motor 40 extending outwardly of its machine 10,12 beyond such end frame member 20 in parallel relation to the shaft 34 of the drum 28 of the machine. The shaft 34 of the drum 28 of each machine 10,12 has a sprocket 42 rigidly affixed to the end thereof which extends outwardly of the end frame member 20 on which the motor 40 is mounted and the drive shaft 40' of the motor 40 is provided with a similar sprocket 44, an endless timing chain 46 being trained about the sprockets 42,44 to impart rotation of the electric motor drive shaft 40' to the shaft 34 of the drum 28 to rotate the drum 28 peripherally tangentially to the substrate S in the same direction of travel thereas. For safety purposes, each machine 10,12 is provided with an emergency drum stop switch 81 actuated by depression thereagainst of a bar 82 which extends across the full width of each side of each machine 10,12 and is thereby operative to stop the electric motors 40 to prevent rotation of the drums 28 whenever a bar 82 is contacted and depressed, thereby to reduce any likelihood of accidental injury by insertion of an operator's hand, arm or piece of clothing into the area of the nip between the nozzle 26 and drum 28 of either machine 10,12.

Each applicator nozzle 26 includes a length of a flat-sided, cross-sectionally square metal tubes 48 the ends of which are sealed by end plates 50 appropriately bolted thereto. The hollow central cavity of the tube 48 thus provided forms a foam distribution chamber 52. In one surface 48' of the tube 48 are formed foam inlet openings 54 adjacent the ends of the tube 48 and a closeable foam outlet opening 56 intermediately thereof, the foam inlet openings 54 being connected by appropriate conduits 58 to a foam generating apparatus (not shown) which may be of any conventional construction but is preferably of the type disclosed in the aforementioned U.S. Pat. No. 4,237,818, and the outlet opening 56 being connected by a conduit 60 to a waste liquid recovery tank (not shown) or other suitable recovery arrangement. In the opposite surface 48'' of the tube 48, which forms a substrate engaging surface, is formed a plurality of apertures 62 extending between the distribution chamber 52 and such surface 48'' along the length of the tube 48 for emitting foamed treating liquor for application to the substrate S. To permit the use of the machines 10,12 for treating substrates of differing widths, an appropriate aperture-covering slide arrangement or the like may be provided in each end of each nozzle 26 for selectively covering some of the apertures 62 thereof to prevent communication therethrough from the distribution chamber 52 to the surface 48'' thereof for varying selectively the longitudinal extent along each nozzle 26 of operative, open apertures 62 as may be necessary to conform the effective width of the nozzles 26 to substrates of differing widths. An angled guide plate 63 is affixed to each opposite side 48''' of each tube 48 to guide the substrate S to and from the nip between the nozzle 26 and the drum 28 of each machine 10,12.

Figure 7:
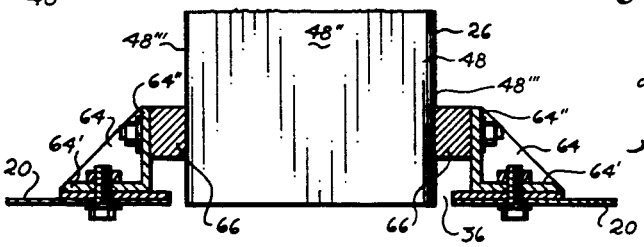
FIG. 7 is a partial horizontal sectional view of the guide assembly for one end of the applicator nozzle of the second liquor-applying apparatus of FIG. 2 taken along line 7—7 of FIG. 6.

The tube 48 of each applicator nozzle 26 is of a selected length sufficient to extend between the end frame members 20 of its respective machine 10,12. As best seen in FIG. 7, an angle bracket 64 is bolted by one leg 64' thereof to the inward side of each end frame member 20 along each edge of the slot 36 thereof and each angle bracket 64 has affixed to the free leg 64'' thereof a bearing block 66 which extends therefrom inwardly of the slot 36. The applicator nozzle 26 of each machine 10,12 is disposed to extend horizontally between the end frame members 20 thereof on the opposite side of the path of the substrate S from the drum 28 of its machine 10,12 with the apertured surface 48'' of the nozzle 26 facing the substrate S and with the ends of the nozzle 26 extending respectively into the slots 36 and engaged on opposite sides by the bearing blocks 66 thereat. (See FIG. 7). In the machine 12, two cross member plates 68 of the frame 18 extend transversely between the cross members 23 at equal inward spacings respectively from the end frame members 20 and the cross member plates 68 support respectively thereon two conventional pneumatically-operated piston and cylinder assemblies 70, the pistons 72 of which extend downwardly through the cross member plates 68 and are affixed to the surface 48' of the nozzle 26 of the machine 12 to support it in the above-described disposition. Similarly, in the machine 10, two piston and cylinder assemblies (not shown) are supported on appropriate frame members of the base framework 21 of the frame 18 below the substrate path and the pistons thereof extend upwardly and are affixed to the side 48' of the nozzle 26 of the machine 10 to support it in the above-described disposition.

The pneumatically-operated piston and cylinder assemblies are commonly connected operatively by a conduit 73 to a conventional source of compressed air and the assemblies will thus be understood to provide for selective movement of each applicator nozzle 26 of the machines 10,12 toward any away from its associated drum 28 by the opening and closing, respectively, of the conduit 73 to communication with the compressed air source, the purpose of which will be hereinafter more fully described. Preferably, the piston and cylinder assemblies are of the construction illustrated in FIG. 4, including a hollow cylindrical housing 74 in which an expansible diaphragm 76 is sealably mounted at one end thereof with the piston 72 joined to the diaphragm 76 and extending outwardly through the opposite end of the housing 74. An air inlet fitting 78 is connected to the conduit 73 and extends sealably through the aforesaid one end of the housing 74 and into the confines of the diaphragm 76, whereby the direction of compressed air through the fitting 78 and into the diaphragm 76 effects expansion thereof and causes the piston 72 to be reciprocated outwardly from the aforesaid opposite end of the housing 74. A coiled spring 80 is disposed about the piston 72 between the diaphragm and such opposite end of the housing 74 to effect return of the diaphragm 76 and the piston 72 upon the relief of the compressed air from the diaphragm 76. In this manner, the piston and cylinder assemblies are operable to exert a balanced force along the length of the nozzles 26 of the machines 10,12 toward the respective drums 28 thereof for balanced compression of the substrate S between the drum 28 and applicator nozzle 26 of each machine 10,12 for driving engagement of the substrate S by each drum 28 to impart movement thereto in its direction of travel and to confiningly cover the apertures 62 of each nozzle 26 sufficiently to prevent escape of the foamed liquor laterally from the apertures 62 and to confine the emission of the foamed liquor therethrough to control the application thereof to the substrate S, as hereinafter more fully described.

The operation of the machines 10,12,14 will thus be understood. In starting up the operation of the machines 10,12, 14, the supply of compressed air to the piston and cylinder assemblies of each machine 10,12 is closed by an appropriate switch or the like (not shown) whereby the applicator nozzle 26 and drum 28 of each machine 10,12 are spaced apart for threading of the substrate S sequentially through each machine 10,12. The transport device 14 is similarly provided with an appropriate conventional mechanism for separating its nip rolls 16 for threading of the substrate S therethrough. The substrate S is threaded through the machines 10,12,14 by feeding it through the openings between the associated nozzles 26 and drums 28 of the machines 10,12 and through the opening between the nip rolls 16 of the machine 14. Thereafter the supply of compressed air is opened to the piston and cylinder assemblies of the nozzles 26 of the machines 10,12 to bring the respective applicator nozzles 26 into compressive engagement with the substrate S to grip it between the nozzles 26 and their associated drums 28. As necessary, the pressure of the compressed air supplied to the piston and cylinder assemblies is adjusted in conventional manner to achieve the appropriate desired compressive force on the substrate S, as explained hereinafter. The nip rolls 16 of the transport device 14 are also brought into their operative disposition to grip the substrate S therebetween. With the respective outlet openings 56 of the nozzles 26 initially open, the foam generating apparatus is actuated to feed foamed treating liquor under pressure through the conduits 54 and the inlet openings 56 of the nozzles 26 into the distribution chambers 52 thereof, the compressive forces exerted by the applicator nozzles 26 on the substrate S creating resistance to the flow of the foamed liquor through the apertures 62 whereby the foamed liquor follows a flow path of lesser resistance and exits the distribution chamber 52 through the outlet openings 56 into the waste liquor recovery tank. In this manner, the foamed liquor purges from the nozzle distribution chambers 52 any liquor chemicals remaining therein from previous use of the machines 10,12 and, further the appearance of the foamed liquor discharged into the recovery tank may be inspected to insure its appropriate desired form and any necessary adjustments in the foam generating apparatus are made. Once the foam appearance is satisfactory, the outlet openings 56 are closed and the drum motors 40 and the nip rolls 16 of the transport device 14 are actuated to begin the ordinary operation of the range.

In the operation of the machines 10,12, the piston and cylinder assemblies exert a uniform balanced force on the respective nozzles 26 biasing them toward their associated drums 28 to uniformly compress the substrate S between the drum 28 and the nozzle 26 of each machine 10,12 as the substrate S travels in its linear path under the impetus of the rotating drums 28. It has been found and is believed desirable that, for virtually any conventional non-woven web substrate of ordinary original thickness (e.g. one to two inches), the piston and cylinder assemblies be adjusted to effect compression thereof to approximately one thirty-secondth of an inch (1/32") to achieve desired restrictive covering of the nozzle apertures. Several distinct and important advantages accrue from this manner of operation. The action of the piston and cylinder assemblies compresses the substrate S with sufficient force to maintain it against the apertured surface 48" of the nozzle tube 48 in covering relation to the apertures 62 thereof against the emissive force exerted by the pressurized foam through the apertures 62 sufficiently to prevent undesired escape of the foamed treating liquor laterally across the respective apertured substrate engaging surfaces 48" of the nozzles 26 between such surfaces 48" and the substrate S and to confine the emission of the foamed treating liquor at any given moment in the operation to the precise areas of the substrate S covering the apertures 62 at such given moment. As will be understood, the perforations 32' in the outer sheet 32 of each drum 28 permit the escape therethrough of the air component of the foamed liquor which enhances the penetration of the foamed liquor into the substrate S. This resistive force exerted by the piston and cylinder assemblies thus effectively prevents any seepage of foamed liquor laterally from the apertures without application thereof to the substrate S which provides substantially uniform foam application to the substrate, significantly less waste of the required treating and foaming chemicals, as well as substantially reduced or eliminated problems of accumulation of such chemicals on machine parts, thereby alleviating the necessity of continuous washing or cleaning of the machine which is often required with the conventional types of apparatus noted hereinabove.

While the foam is advantageously applied uniformly to the substrate in terms of a uniform width of application and a uniform force or pressure of foam application across the width, it is also applied uniformly in quantity when the substrate is of substantially uniform density. As a practical matter, however, some substrates are not of substantially uniform unit area density throughout their extent and when the present apparatus is used to apply foam to a substantially non-uniform density substrate, the foam will apply itself in greater quantity to less dense areas than to more dense areas because of the lesser resistance of the less dense areas to penetration of the foam, which loads the less dense areas with more foam than the denser areas. This can be a significant advantage when the foam is applied for the purpose of loading the substrate as it results in a leveling of the weight per unit area across the width of the ultimate foam treated substrate. But even with a substantially non-uniform density substrate, the foam is applied uniformly in terms of width of application and force or pressure of foam application.

Figure 8:
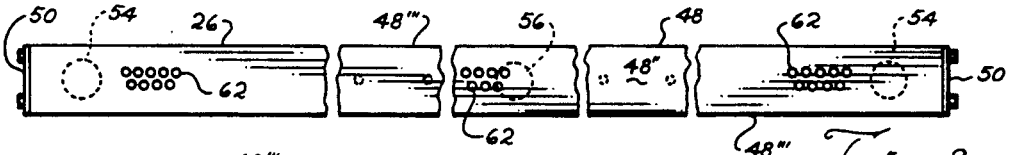
FIG. 8 is a bottom view of the applicator nozzle of the second liquor-applying apparatus of FIG. 2.
Figure 9:
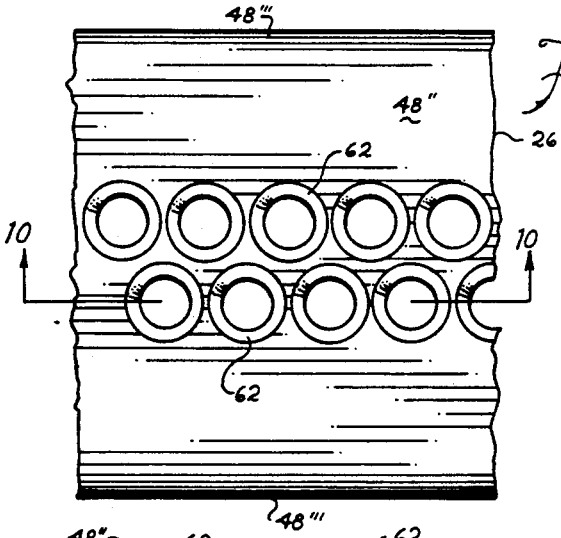
FIG. 9 is an enlargement of a portion of the substrate engaging surface of the applicator nozzle of FIG. 8.
Figure 10:
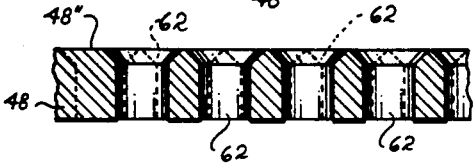
FIG. 10 is a vertical sectional view of the portion of the substrate engaging surface of the applicator nozzle of FIG. 9 taken along line 10—10 thereof.
Figure 6:
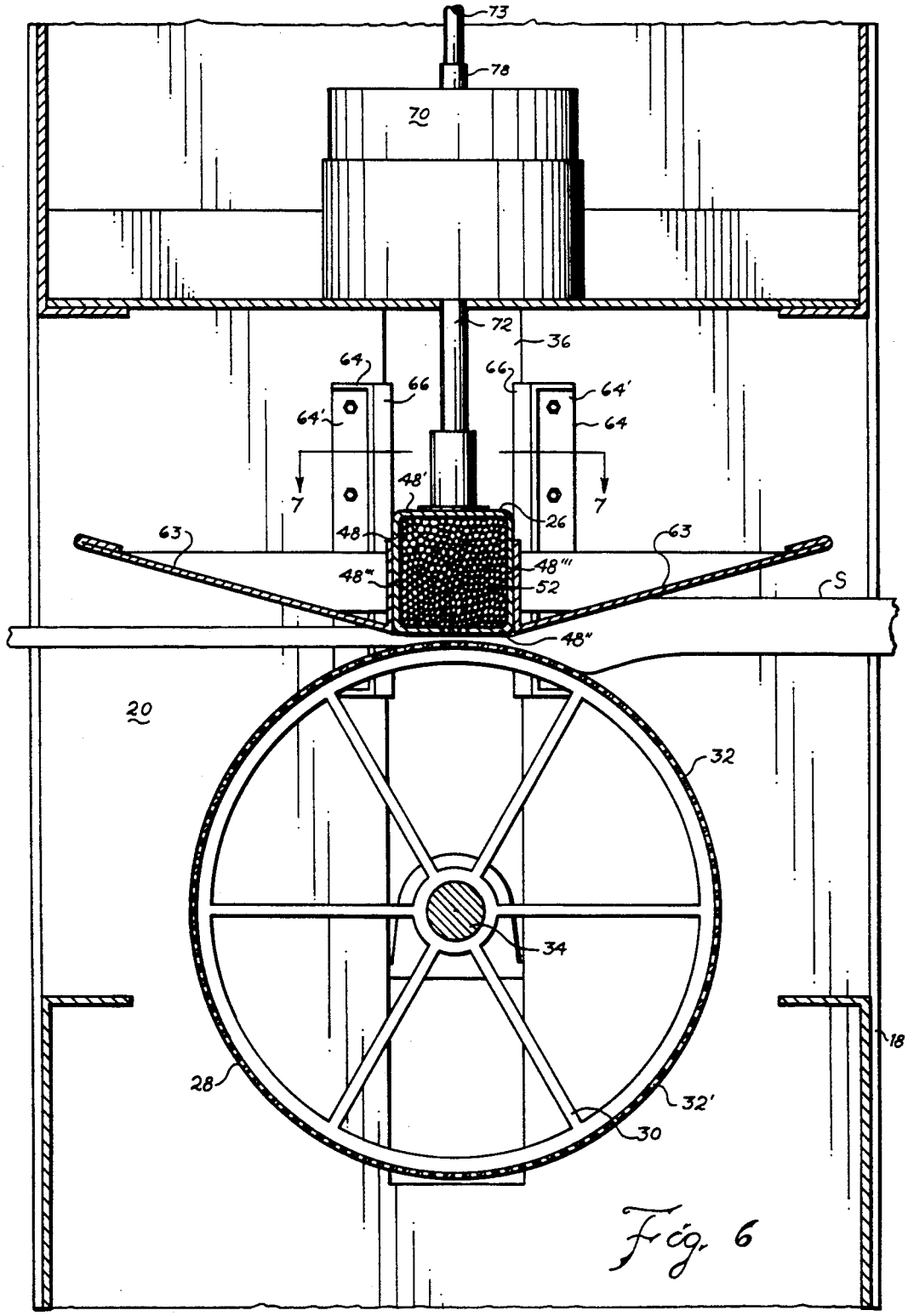
FIG. 6 is a partial vertical sectional view of the second liquor applying apparatus of FIG. 2 taken along line 6—6 of FIG. 4.

To ensure that the foamed treating liquor is applied by each nozzle 26 to the entire widthwise extent of the substrate S, the apertures 62 of the surface 48" of each nozzle 26 are arranged equally spaced in several linear rows, preferably two, extending along the length of the nozzle 26 and the apertures 62 of each row are staggered relative to the apertures 62 of the other row (or rows, if more than two rows are provided) so as to overlap in the linear direction of travel of the substrate S. (See FIGS. 8–10). Further, the apertures 62 are preferably formed by countersink drilling such that each aperture 62 is outwardly flared at the surface 48" of each nozzle 26 thereby inreasing the area of application to the substrate S of each aperture 62. In this manner, the apertures 62 of each nozzle 26 collectively are substantially comparable in area and effective foam application to conventional nozzles of the type having a single longitudinal slot for foam emission therethrough and, accordingly, are equally effective to apply the foamed treating liquor across the entire widthwise extent of the substrate S. Preferably, the apertures 62 of each row are as closely spaced as feasible, e.g. one thirty-secondth of an inch (1/32") in the illustrated embodiment at the engaging surface 48" and the apertures of adjacent rows are staggered and arranged substantially tangential respectively to an imaginary line extending between the aperture rows, thereby to best achieve the above-described effect. Notably, however, the apertured nozzle 26 of the present apparatus provides sufficient bridging between the respective apertures 62 thereof to prevent significant compression of the substrate S into the apertures 62 which would restrict the traveling movement of the substrate S across the engaging surfaces 48" of the nozzles 26 and thereby could cause tearing or other damage of the substrate S and, thus, the present apparatus eliminates this disadvantage attendant to slotted nozzles and the various conventional apparatus in which they are incorporated which contributes to render such apparatus unsuitable for foamed treatment of non-woven substrates.

Figure 11:
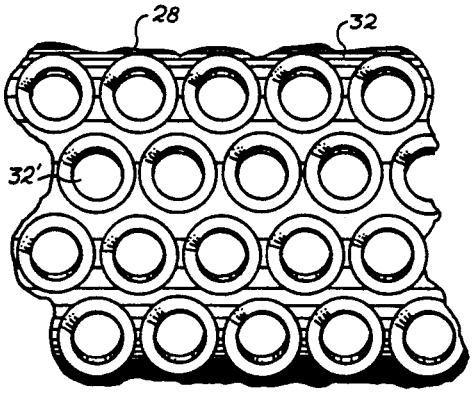
FIG. 11 is an enlarged side elevational view of the peripheral surface of the driven drum of the second liquor-applying apparatus of FIG. 2.

Similarly, the perforations 32' in the outer sheet 32 of each drum 28 are formed closely-spaced about the entire peripheral area of each drum 28, the perforations 32' being arranged in closely-spaced and staggered linear rows of countersunk holes extending axially along the length of each drum 28 to maximize the perforated peripheral surface area of each drum 28 to insure adequate escape flow paths for the air component of the foamed liquor so as to best enhance uniformity of foam penetration into the substrate S. (See FIG. 11).

Further, although the substrate S is subjected to the above-described compressive forces, it is not subjected to any significant pulling force exerted along its length which could tend to cause it to tear. The impetus for the traveling movement of the substrate S through the machines 10,12 is provided by the rotational engagement of the substrate S by the respective drums 28 which effectively exert a pushing action on the compressed portions of the substrate S. Notably, at any given moment, the substrate S is in surface engagement with the nozzles 26 and the drums 28 across the full widthwise extent of the substate S but to only a relatively small extent along its lengthwise extent in the direction of its travel whereby the frictional forces between the substrate S and the nozzles 26 and drums 28 are limited and the frictional resistance to its travel is reduced. Similarly, the function of the nip rolls 16 of the transport device 14 is merely to impart movement of the treated substrate S to the next station in the treating range and the transport device accordingly is not arranged to exert any pulling action on the substrate S. Furthermore, inasmuch as the substrate S has been treated prior to reaching the transport device 14, there is less danger of tearing of the substrate S in any event.

As will be appreciated by those skilled in the art, the quantity of the foamed treating liquor applied to the substrate S per unit area thereof may be selectively controlled by varying in conventional manner the quantity of the treating chemicals fed into the foam generating apparatus while cooperatively varying the rotational speed of the drums 28. Similarly, the depth to which the foamed liquor penetrates the substrate S may be effectively varied by controlling the relative volume of the air component of the foam thereby to control the foam pressure. In the illustrated and above-described embodiment of the present foamed liquor applying apparatus, two such apparatus are serially-arranged for successively treating respectively the opposite sides of the substrate S. Thus, the respective foamed liquor applying apparatus incorporated in each machine 10,12 effects a decreasing penetration of the foaming liquor through the substrate S by each such apparatus with a resulting combined uniform penetration of the foam into the substrate. Advantageously, this arrangement of the two machines 10,12 also permits the application of different treating liquors to the opposite sides of the substrate S, if desired. It is to be understood, however, that the single foamed liquor applying apparatus of either machine 10 or 12 alone may be equally effective to apply a suitable foamed liquor through substantially the entire depth of the substrate S by the above-noted control parameters. The employment of two successive apparatus instead of one apparatus is considered to be ordinarily preferred in order to best obtain uniform foam penetration through the substrate and further to reduce any likelihood that excess foam may penetrate the substate S and enter the drums 28.

It will thus be understood that the present foam applying apparatus effectively applies foamed treating liquor to the traveling substrate S by an extremely clean, economical operation in which virtually all foamed liquor emitted from the applicator nozzles 26 is applied to the substrate S and the present apparatus will be seen accordingly to be especially and advantageously adapted for use in treating fibrous textile substrates of non-woven, non-knitted character the structural integrity of which relies substantially on the cohesive forces between the fibers of the substrate. Substrates of this type present unique treating problems in that careful handling of traveling substrates of this type is necessary to prevent tearing or other damage thereto and, for this reason, treating apparatus conventionally employed with traveling woven, knitted or other substrates the fibers or yarns of which are mechanically integrated is unsuitable. The special non-woven substrate treating apparatus of the type described above have accordingly evolved along with the attendant problems. The present apparatus eliminates the problems heretofore so associated with the conventional treatment of traveling non-woven substrates by providing a means by which non-woven substrates may be firmly but limitedly engaged by a foam liquor applicator in a manner applying the foamed liquor directly to the substrate only while also transporting the substrate in its intended traveling path without exerting any significant potentially damaging force on the substrate. Application of the treating foam to any operative parts of the apparatus, and the resultant need for cleaning thereof, are eliminated.

Of course, it is to be understood that the present apparatus is of broad applicability to and utility for the application of any type of foamed treating liquor to virtually any type of air permeable traveling substrate and it is, accordingly, contemplated that the present apparatus may be equally well employed for the foamed treatment of conventional knitted and woven fabrics.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

We claim:

1. Apparatus for applying foamed treating liquor to a flat width of traveling substrate, such as a fibrous non-woven batting, comprising an applicator nozzle having a substantially flat longitudinal substrate engaging surface disposed to extend transversely across said width of said traveling substrate in direct surface contact compressively with one side thereof, said nozzle having internally thereof a foam distribution chamber communicating with a means for supplying foamed treating liquor under pressure and said nozzle having a plurality of closely spaced apertures extending between said chamber and said engaging surface along the length thereof for emitting said foamed treating liquor for application to said one side of said substrate, a rotatably mounted cylindrical drum axially disposed substantially parallel and in opposition to said engaging surface of said nozzle transversely across the width of the opposite side of said substrate in peripheral surface contact therewith, and means for driving said drum said nozzle and said drum being relatively compressively disposed for substantial compressing of said substrate therebetween sufficient for driving engagement of said substrate by said drum to impart movement thereto in its direction of travel and for compressing said substrate against said substrate engaging surface in covering relation to said apertures sufficiently to substantially prevent escape of said foamed treating liquor laterally across said substrate engaging surface between it and said substrate and to substantially confine the emission of said foamed treating liquor through said apertures to said substrate for controlled application of said foamed treating liquor to said one side of said substrate, whereby said foamed treating liquor is applied to said one side of said substrate uniformly across its width and along its length as it travels past said nozzle.

2. Apparatus for applying foamed treating liquor according to claim 1 and characterized further in that said apertures are arranged in linear rows extending transversely across said width of said traveling substrate, said apertures of differing rows being staggered relative to said apertures of other rows such that said plurality of apertures collectively apply said foamed treating liquor across the entire widthwise extent of said substrate.

3. Apparatus for applying foamed treating liquor according to claim 2 and characterized further in that said apertures of different rows staggeringly overlap in the direction of substrate travel.

4. Apparatus for applying foamed treating liquor according to claim 3 and characterized further in that each said aperture is outwardly flared to said substrate engaging surface to increase the area of application to said substrate of each said aperture.

5. Apparatus for applying foamed treating liquor according to claim 4 and characterized further in that said apertures are arranged in two parallel rows.

6. Apparatus for applying foamed treating liquor according to claim 1 or 5 and characterized further in that said nozzle includes a tubular member forming therewithin said chamber and having at least one flat side forming said substrate engaging surface in which flat side is formed said plurality of apertures.

7. Apparatus for applying foamed treating liquor according to claim 6 and characterized further in that said substrate travels in a path widthwise parallel to horizontal, said substrate engaging surface being horizontally disposed to face upwardly for engagement and application of said foamed treating liquor to the underside of said substrate.

8. Apparatus for applying foamed treating liquor according to claim 6 and characterized further in that said substrate travels in a path widthwise parallel to horizontal, said substrate engaging surface being horizontally disposed to face downwardly for engagement and application of said foamed treating liquor to the upwardly facing side of said substrate.

9. Apparatus for applying foamed treating liquor according to claim 6 and characterized further in that said substrate is a non-woven, non-knitted fibrous mat bonded together substantially only by cohesion, said substrate engaging surface being of a relatively small extent in the direction of substrate travel for limiting contact therewith to reduce frictional resistance to the traveling movement of said substrate.

10. Apparatus for applying foamed treating liquor according to claim 1 and characterized further in that said drum is indentedly relief-formed about its peripheral surface for escape of the air content of said foamed treating liquor through said substrate into the indentations of said peripheral surface of said drum thereby to enhance penetration of said substrate by said foamed treating liquor.

11. Apparatus for applying foamed treating liquor according to claim 10 and characterized further in that said drum is hollow and includes a plurality of perforations in its peripheral surface.

12. Apparatus for applying foamed treating liquor according to claim 11 and characterized further in that said perforations are closely spaced and staggered both axially and circumferentially about the entire peripheral surface of said drum.

13. Apparatus for applying foamed treating liquor according to claim 12 and characterized further in that said perforations are arranged in a plurality of axially-extending rows and said perforations of differing rows are staggered relative to said perforations of other rows such that said perforations of adjacent rows staggerlingly overlap circumferentially about said drum, said perforations being outwardly flared to said peripheral surface to increase the indentedly relief-formed surface area of said drum.

14. Apparatus for applying foamed treating liquor according to claim 1 and characterized further by means biasing said nozzle and said drum together to provide the compressive force exerted therebetween on said substrate.

15. Apparatus for applying foamed treating liquor according to claim 14 and characterized further by means for selectively adjusting the rotational speed of said drum for controlling the quantity of said foamed treating liquor applied to said substrate per unit area thereof.

16. Apparatus for applying foamed treating liquor according to claim 14 and characterized further in that said drum has a fixed axis and said biasing means is operatively associated with said nozzle for controlling the disposition of said nozzle relative to said drum.

17. Apparatus for applying foamed treating liquor according to claim 16 and characterized further in that said biasing means includes pneumatically-operated piston and cylinder means on which said nozzle is mounted for movement toward and away from said drum.

18. Apparatus for applying foamed treating liquor according to claim 17 and characterized further in that said pneumatically-operated piston and cylinder means includes a pair of pneumatically-operated piston and cylinder assemblies joined to said nozzle at a spacing therealong and pneumatically connected for providing a balanced biasing force along the length of said nozzle toward said drum.

19. Apparatus for applying foamed treating liquor according to claim 1 and characterized further by a second applicator nozzle, a second rotatably mounted cylindrical drum sequentially following said first-mentioned applicator nozzle and said first-mentioned drum for applying said foamed treating liquor to said opposite side of said substrate following application of said foamed treating liquor by said first-mentioned applicator nozzle and said first-mentioned drum to said one side of said substrate, and means for driving said second cylindrical drum said second applicator nozzle having a respective substantially flat longitudinal substrate engaging surface disposed to extend transversely across said width of said traveling substrate in direct surface contact compressively with said opposite side thereof, said second nozzle having internally thereof a respective foam distribution chamber communicating with said means for supplying foamed treating liquor under pressure and said second nozzle having a respective plurality of closely spaced apertures extending between its said chamber and its said engaging surface along the length thereof for emitting said foamed treating liquor for application to said opposite side of said substrate, and said second rotatably mounted cylindrical drum being axially disposed substantially parallel and in opposition to said engaging surface of said second nozzle transversely across the width of said one side of said substrate in peripheral surface contact therewith, said nozzle and said drum being relatively compressively disposed for substantial compressing of said substrate therebetween sufficient for driving engagement of said substrate by said drum to impart movement thereto in its direction of travel and for compressing said substrate against said engaging surface of said second applicator nozzle in cover relation to its said apertures thereof sufficiently to substantially prevent escape of said foamed treating liquor laterally across its said substrate engaging surface between it and said substrate and to substantially confine the emission of said foamed treating liquor through its said apertures onto said substrate for controlled application of said foamed treating liquor to said opposite side of said substrate, whereby said foamed treating liquor is applied to said opposite side of said substrate uniformly across its width and along its length as it travels past said second nozzle.

20. Apparatus for applying foamed treating liquor according to claim 19 and characterized further in that said substrate is a non-woven, non-knitted fibrous mat bonded together substantially only by cohesion and travels in a path widthwise parallel to horizontal, said substrate engaging surface of one of said first and second applicator nozzles being horizontally disposed to face upwardly for engagement and application of said foamed treating liquor to the underside of said substrate and said substrate engaging surface of the other of said first and second applicator nozzles being horizontally disposed to face downwardly for engagement and application of said foamed treating liquor to the upwardly facing side of said substrate, each said substrate engaging surface being of a relatively small extent in the direction of substrate travel for limiting contact therewith to reduce frictional resistance to the traveling movement of said substrate.

21. Apparatus for impregnating a porous substrate with a foam comprising a foam discharge head having a surface plate adapted with one or more discharge openings for the discharge of foam therethrough, a foraminous drum positioned opposite said discharge openings to define a nip region, said foraminous drum being adapted to transport the porous substrate through said nip region, means for supplying foam to said foam discharge head with pressure sufficient to discharge foam through said discharge openings to impregnate the porous substrate, and means for urging said foam discharge head toward said foraminous drum to apply a force to the porous substrate to urge the porous substrate into sealed relation with said surface plate so that foam is substantially prevented from accumulating at the interface of said foam discharge head and the porous substrate as the porous substrate is transported through said nip region.

* * * * *